US007017193B2

(12) United States Patent
Auger

(10) Patent No.: US 7,017,193 B2
(45) Date of Patent: Mar. 28, 2006

(54) MEN'S SPORTS BRIEF

(76) Inventor: Yvan Auger, 4080, Joliette, Montreal Quebec (CA) H1X 3H9

( * ) Notice: Subject to any disclaimer, the term of this patent is extended or adjusted under 35 U.S.C. 154(b) by 0 days.

(21) Appl. No.: 10/330,794

(22) Filed: Dec. 30, 2002

(65) Prior Publication Data

US 2004/0154078 A1 Aug. 12, 2004

(51) Int. Cl.
*A41D 13/00* (2006.01)

(52) U.S. Cl. ..... 2/403; 2/466

(58) Field of Classification Search ..... 2/400, 2/402, 403–405, 228, 239, 238, 240, 227, 2/73, 78.1–78.4, 22–24, 69, 79, 455, 456, 2/466; 602/67–73; D2/712, 713, 731, 732, D2/742, 743
See application file for complete search history.

(56) References Cited

U.S. PATENT DOCUMENTS 1,984,875 A * 12/1934 Heyn ..... 2/228
2,138,481 A * 11/1938 Chatfield ..... 2/403
2,191,169 A * 2/1940 Katz ..... 2/228
2,328,953 A 9/1943 Chatfield
2,384,165 A * 9/1945 Goldfarb et al. ..... 2/228
2,493,822 A * 1/1950 Meggs ..... 2/401
3,499,442 A 3/1970 Steinmetz
3,501,774 A * 3/1970 Norman ..... 2/321
3,517,666 A 6/1970 Atlee
4,173,976 A 11/1979 Bloomquist
4,811,427 A * 3/1989 Regan ..... 2/227
5,157,793 A 10/1992 Michels
5,379,462 A 1/1995 Morgan
5,461,729 A 10/1995 Brocks
5,608,915 A * 3/1997 Libit ..... 2/228
5,974,592 A * 11/1999 Tabrizi ..... 2/400
6,041,441 A * 3/2000 Counts et al. ..... 2/227
6,243,880 B1 6/2001 Lyden
6,289,520 B1 * 9/2001 Page ..... 2/403
6,353,940 B1 3/2002 Lyden

* cited by examiner

*Primary Examiner*—Gloria M. Hale

(57) ABSTRACT

Male sports brief having special pocket for genitals and stitches arranged for increased comfort.

4 Claims, 2 Drawing Sheets

MEN'S SPORTS BRIEF

BACKGROUND OF THE INVENTION

1. Field of the Invention

This invention relates generally to sporting outfit and more specifically to male briefs.

2. Background

It has been known for years that male genitalias require special protection during rough activities. The familiar "jock strap" has been a staple of men's sporting equipment for decades. Although the hard shell of a jock strap can absorb the shock of a direct hit and for that it is useful in its own right but that same hardness can also turn against a sportsman when, after executing a certain move, such as moving a thigh towards the abdomen and thus pushing the jock strap against the testicles.

For this reason, sports briefs have been developped to help secure male genitalias in place since it has been found that it is less of an occurence for a sportsman to receive a direct hit on the genitals than having one's testicles shaken during typical moves while engaging in a sporting activity.

Unfortunately, even though the prior art shows a wide variety of sports briefs. It appears that they all miss on one point or another. A man's anatomy is quite complex and involves more than just the genitals, buttocks are also important and so is the lower abdomen. So in order to avoid other inconveniences such as "wedgies" or the rounded abdomen which tends to push down on the briefs and thus freeing genitals which would otherwise be neatly tucked away, other design elements in the briefs must be introduced. There is therefore a need for a new and improved type of men's sports brief.

SUMMARY OF THE INVENTION

One object of the present invention is to provide a men's sports brief which supports genitals.

A second object is to provide specific locations for stitches joining separate pieces of the brief to better fit the anatomy.

A final object is to provide protection and comfort.

In order to do so, the brief described herein has a set of specially cut components which are sewn in specific ways to work synergistically in order to provide all the advantages described.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

Figure 1:
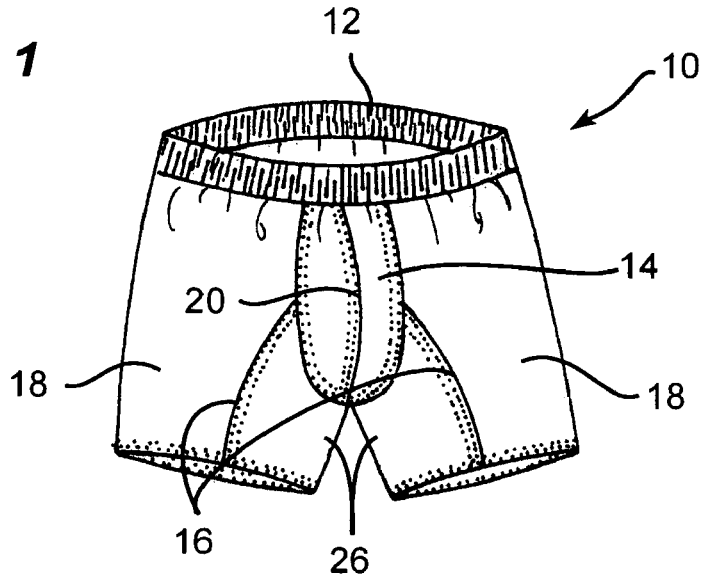

FIG. 1 Front view of men's sports brief.

Figure 2:
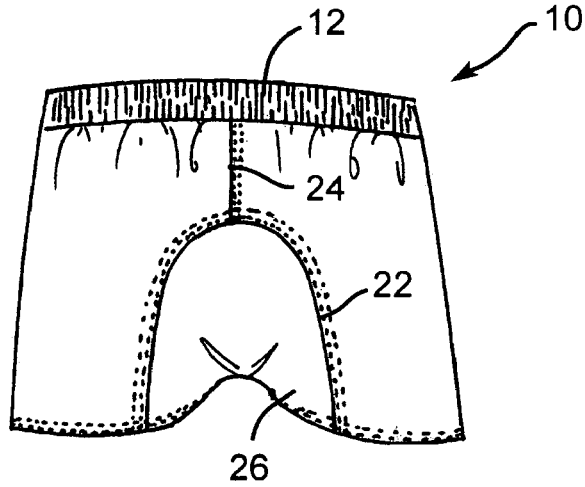

FIG. 2 Rear view of men's sports brief.

Figure 3:
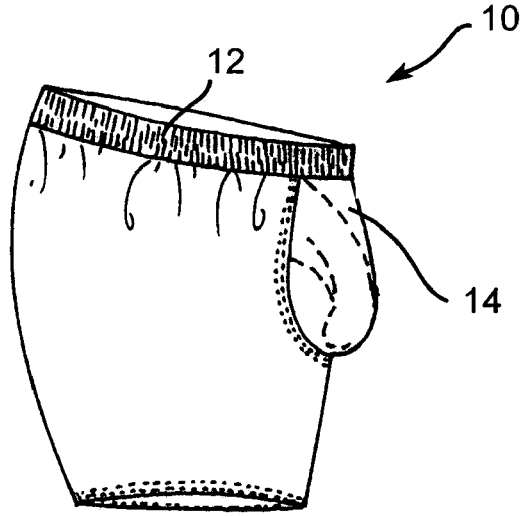

FIG. 3 Side view men's sports brief.

Figure 4:
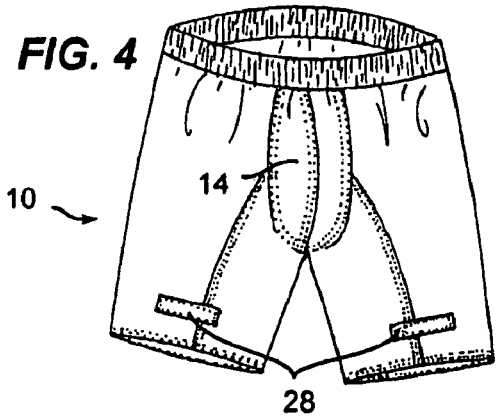

FIG. 4 Front view of men's 1st variation sports brief.

Figure 5:
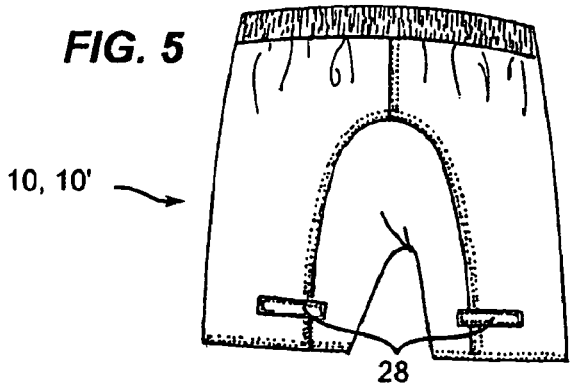

FIG. 5 Rear view of men's 1st and 2nd variation sports brief.

Figure 6:
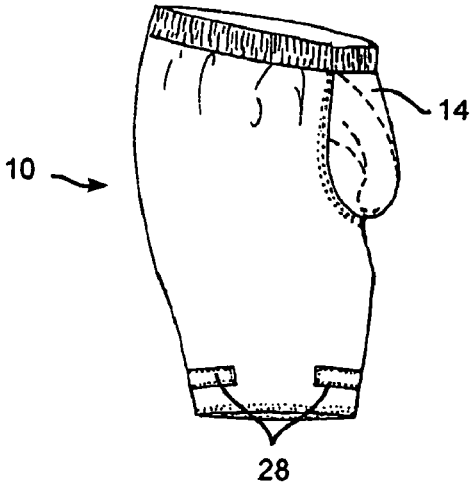

FIG. 6 Side view men's 1st variation sports brief.

Figure 7:
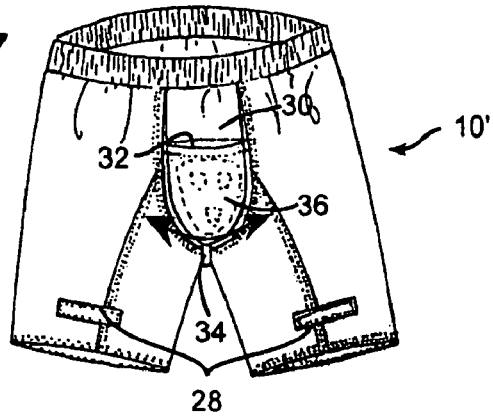

FIG. 7 Front view of men's 2nd variation sports brief.

Figure 8:
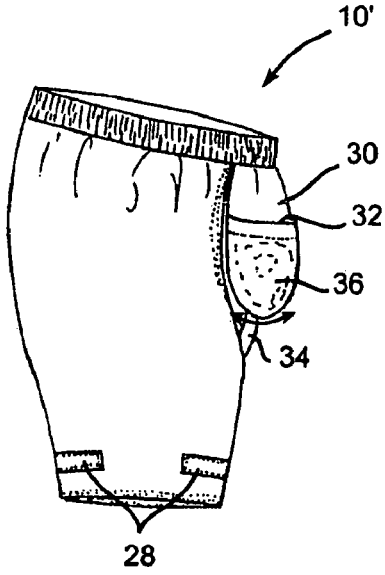

FIG. 8 Side view men's 2nd variation sports brief.

DETAILED DESCRIPTION OF THE PREFERRED EMBODIMENT

FIG. 1 A men's sports brief (10) is comprised of a waistline (12) having an inclined contour and generally comprising an elastic band to make it adjustable. The front of the men's sports brief (10) is comprised of a genitals pocket (14). Special stitches (16) run from a point about halfway the height of the genitals pocket (14) down to the bottom of the brief's legs (18) where they are set towards the middle as seen from a front view. The genitals pocket (14) also has a pocket stitch (20) running vertically across its height.

FIG. 2 From the back, the men's sports brief has an inverted "U" shaped stitch (22) and at the apex of that "U" shaped stitch (22) is a small stitch (24) running vertically therefrom until it reaches the waistline (12). From the special stitches (16) as seen in FIG. 1 to the "U" shaped stitch (22), there is only one piece of fabric which forms a crutch (26). By eliminating any stitches in this area, a comfortable zone is created which reduces the <<wedgy>> feeling.

FIG. 3 From the side, the protruding aspect of the genitals pocket (14) can be better appreciated along with the sloping configuration of the waistline (12) which more faithfully espouses the contour of the male anatomy. The genitals pocket is shaped to more appropriately receive the genitals (14) and in that respect is superior to those found in the prior art.

FIG. 4 For certain sporting activities, most notably ice hockey, other pieces of equipment is preferably attached directly to the brief (10) in such a case, velcro (™) retainers (28) are sown directly into the legs (18) both at the front and the back as seen in FIGS. 4, 5 and 6 to form the first variation.

FIG. 7 In this front view of men's 2nd variation sports brief and in FIG. 8 with the side side view, there is the addition of a jock hard shell pocket (30) having an opening (32) to place a shell (36) therein. The shell pocket (30) has a loose retainer (34) which allows the pocket a limited range of motion. Indeed, when a hard shell is restricted in its leeway, an injury can occur when a testicle slips out from the brief and is squeezed by an otherwise immobile shell (36). By limiting the range of motion of the shell, the shell pocket (30) does not become a liability by moving so much as to conflict with the genitals.

The invention claimed is:

1. A men's sports brief comprising:

a waistline having an inclined contour, higher at a user's rear and lower at a user's front, comprising an elastic band;

a genitals pocket situated at the front of the user that supports the genitals;

a crotch panel; two side panels;

a first seam joining the genitals pocket and the side panels, travelling from the longitudinal midpoint of the genitals pocket towards a brief leg bottom;

a second seam travelling vertically in the centre of the genitals pocket panel;

a third seam in an inverted u-shape joining the pair of side panels to a rear portion of the crotch panel;

a fourth seam above the third seam joining the side panels at the rear of the user;

and a fifth seem joining the lower portion of the genitals pocket with a front portion of the crotch panel.

2. A men's sports brief as in claim 1, further comprising:

a hard shell pocket having an opening to place a shell therein;

said shell pocket having a retainer to allow the pocket a limited range of motion.

3. A men's sports brief as in claim 1, further comprising:

hook and loop retainers sewn directly into the brief legs.

4. A men's sports brief as in claim 2, further comprising:

hook and loop retainers sewn directly into the brief legs.

* * * * *